US007782196B2

(12) United States Patent
Piper, Sr. et al.

(10) Patent No.: US 7,782,196 B2
(45) Date of Patent: Aug. 24, 2010

(54) ENTRANCE SECURITY SYSTEM

(75) Inventors: Douglas E. Piper, Sr., Greenville, SC (US); Thomas E. Browning, Jr., Spartanburg, SC (US); Mary Hester Owens, Simpsonville, SC (US); Clifford Leroy DeYoung, Woodruff, SC (US); Sam Snead Shasteen, Greenville, SC (US)

(73) Assignee: Woven Electronics, LLC, Greenville, SC (US)

( * ) Notice: Subject to any disclaimer, the term of this patent is extended or adjusted under 35 U.S.C. 154(b) by 634 days.

(21) Appl. No.: 11/655,433

(22) Filed: Jan. 19, 2007

(65) Prior Publication Data

US 2008/0174428 A1 Jul. 24, 2008

Related U.S. Application Data

(63) Continuation-in-part of application No. PCT/US2006/014601, filed on Apr. 19, 2006, which is a continuation-in-part of application No. PCT/US2005/040080, filed on Nov. 5, 2005, which is a continuation-in-part of application No. PCT/US2005/040079, filed on Nov. 4, 2005, which is a continuation-in-part of application No. PCT/US2004/013494, filed on May 3, 2004, which is a continuation-in-part of application No. 10/429,602, filed on May 3, 2003, application No. 11/655,433, which is a continuation-in-part of application No. 11/083,038, filed on Mar. 17, 2005, application No. 11/655,433, which is a continuation-in-part of application No. PCT/US2004/013494, filed on May 3, 2004, which is a continuation-in-part of application No. 10/429,602, filed on May 3, 2003.

(60) Provisional application No. 60/673,699, filed on Apr. 21, 2005, provisional application No. 60/626,197, filed on Nov. 9, 2004.

(51) Int. Cl.
*G08B 13/00* (2006.01)

(52) U.S. Cl. ..... 340/541; 340/545.1; 340/555; 340/556; 340/564; 340/565; 250/216; 250/227.14; 250/227.23; 250/227.26; 356/73

(58) Field of Classification Search ..... 340/541, 340/542, 550, 545.1, 545.3; 250/221, 216, 250/227.14, 227.19, 227.23, 227.26; 385/135, 385/136

See application file for complete search history.

(56) References Cited

U.S. PATENT DOCUMENTS 4,369,437 A 1/1983 Thompson, Jr. et al.

(Continued)

FOREIGN PATENT DOCUMENTS

GB 2 247 095 A 2/1992
WO WO 2006/052777 5/2006

*Primary Examiner*—Davetta W Goins
(74) *Attorney, Agent, or Firm*—McNair Law Firm, PA; Cort Flint

(57) ABSTRACT

An entrance denial security system for detecting a fault condition at one or more entrances into a secured area representing unauthorized activity and an attempt to gain entry through the entrance. The system comprising an entrance barrier closing an entrance into a secured area; the barrier including a plurality of hollow structural elements having hollow cores forming a rigid integral barrier; an optical fiber sensor line laced through the hollow cores of the structural elements of the gate for detecting the fault condition; a processor in communication with the fiber sensor line for generating a fault signal in response to the occurrence of a fault condition and identifying the entrance where the fault condition occurred; and a communication device operatively associated with the processor for communicating the fault signal so that a proper security response can be made to the fault condition.

30 Claims, 8 Drawing Sheets

FIG. 1

U.S. PATENT DOCUMENTS

| | | | | |
|---|---|---|---|---|
| 4,447,123 | A | 5/1984 | Page et al. | |
| 4,777,476 | A | 10/1988 | Dank | |
| 4,814,562 | A | 3/1989 | Langston | |
| 4,829,286 | A | 5/1989 | Zvi | |
| 5,049,855 | A | 9/1991 | Slemon et al. | |
| 5,055,827 | A | 10/1991 | Philipp | |
| 5,434,557 | A | 7/1995 | Alizi | |
| 5,592,149 | A | 1/1997 | Alizi | |
| 5,594,239 | A | 1/1997 | Lessing | |
| 5,790,285 | A | 8/1998 | Mock | |
| 6,002,501 | A | 12/1999 | Smith et al. | |
| 6,937,151 | B1 * | 8/2005 | Tapanes | 340/550 |
| 6,980,108 | B1 * | 12/2005 | Gebbia et al. | 340/555 |
| 7,068,166 | B2 * | 6/2006 | Shibata et al. | 340/541 |
| 7,123,785 | B2 * | 10/2006 | Iffergan | 385/13 |
| 7,402,790 | B2 * | 7/2008 | Browning et al. | 250/221 |
| 2004/0233054 | A1 | 11/2004 | Neff et al. | |
| 2005/0196238 | A1 | 9/2005 | DeGreef | |

* cited by examiner

ENTRANCE SECURITY SYSTEM

CROSS REFERENCE TO RELATED APPLICATIONS

This application claims the benefit of the following applications. This application is a continuation-in-part of PCT application no. PCT/US2006/014601, filed Apr. 19, 2006, entitled "Secure Transmission Cable (WOV 86);" which is a continuation-in-part of PCT application no. PCT/US2005/040080, filed Nov. 5, 2005, entitled "Apparatus And Method For A Computerized Fiber Optic Security System (WOV 82);" which is a continuation-in-part of PCT application no. PCT/US2005/040079, filed Nov. 4, 2005, entitled "Vehicle Denial Security System (WOV 81);" which is a continuation-in-part of PCT application no. PCT/US2004/013494, filed May 3, 2004, entitled "Fiber Optic Security System For Sensing The Introduction Of Secured Locations (WOV 62);" which is a continuation-in-part of U.S. non-provisional application Ser. No. 10/429,602 filed May 3, 2003, entitled "Fiber Optic Security System For Sensing Intrusion Of Secured Locations (WOV 58);" and this application is a continuation-in-part . of U.S. provisional application No. 60/673,699, filed Apr. 21, 2005, entitled "Secure Above Ground Fiber Optic Data Transmission Cable (WOV 71);" and this application is a continuation-in-part of U.S. non-provisional application Ser. No. 11/083,038, filed Mar. 17, 2005, entitled "Apparatus And Method For A Computerized Fiber Optic Security System (WOV 66);" which is a continuation-in-part of U.S. provisional application No. 60/626,197, filed Nov. 9, 2004, entitled "Vehicle Denial Security System" (WOV 65), and this application is a continuation-in-part of PCT application No. PCT/US2004/013494, filed May 3, 2004, entitled "Fiber Optic Security System For Sensing The Introduction Of Secured Locations (WOV 62);" which is a continuation-in-part of U.S. non-provisional application Ser. No. 10/429,602 filed May 3, 2003, entitled "Fiber Optic Security System For Sensing Intrusion Of Secured Locations (WOV 58)."

BACKGROUND OF THE INVENTION

This invention relates to an entry denial security system for denying entry of a vehicle or person into a secured area and/or detecting an attempt to penetrate a barrier closing an entrance into the secured area.

With the increase in terrorism in the United States and the rest of the world, the need for an effective security system to detect and/or prevent the unauthorized entry of a vehicle and/or individual from breaking through a barrier closing an entrance into a secured area is a problem to which considerable attention needs to be given. In particular, an objective of this invention is to provide an entrance security system which detects an unauthorized opening or break through of an entrance barrier closing an entrance of the secured area.

SUMMARY OF THE INVENTION

The above objectives are accomplished according to the present invention by providing a security system for detecting an unauthorized activity and attempt to enter through an entrance of a secured area and determining the nature and location of the activity. The security system comprises an entrance barrier closing the entrance, including a plurality of hollow structural elements forming an integral barrier structure such as an entrance gate (or fixed grate). A first fiber optic sensor line senses a first fault condition representing an unauthorized attempt to open the gate. A second fiber optic senor line senses one of an attempted severance and severance of a structural element of the gate. A first fiber optic scanning unit scans the first optical sensor line and receives scan signals estimating attenuations in the first optical sensor line. A second fiber optic scanning unit scans the second optical sensor line and receives scan signals estimating attenuations in the second optical sensor line. A system computer is provided for receiving and processing the scan signals in real-time representing the condition of the first and second optical sensor lines and generating a real-time fault signal in response to a predetermined attenuation in one or more of the scan signals indicating the unauthorized activity has occurred. A communication device communicates notice of the fault signal to security personnel. Advantageously, the processing of the scan signals includes comparing the first and second real-time scan signals to pre-established first and second baseline scan signals which are characteristic of the first and second sensor lines, respectively, when undisturbed.

The barrier is composed of hollow structural elements having hollow cores, and the first optical sensor line is laced through the hollow cores of the structural elements. When the barrier is an entrance gate, the gate is moveable and has an open position allowing entry and a closed position preventing entry. In this case, the system includes a sensor unit disposed relative to the entrance gate to detect movement of the gate toward the open position and generate a fault signal. The sensor unit includes a reciprocating sensor actuator having a deactivated position and an activated position. The sensor actuator engages the second sensor fiber upon the unauthorized movement of the entrance gate causing the sensor actuator to move to the activated position and the fault signal to be generated. The sensor unit includes a fiber chamber for receiving the second optical sensor line. The reciprocating sensor actuator is carried in the fiber chamber to contact the senor line and form a predetermined bend in the second sensor fiber when activated to produce the predetermined fault signal that is readily recognizable by the processor to reliably detect a sensor activation.

In another aspect of the invention, a method of preventing an unauthorized entry through an entrance into a secured area comprises providing an optical fiber sensor line laced through a plurality of structural elements forming a barrier closing the entrance. The method includes generating real-time scan signals in the fiber sensor line representing the current state of the fiber sensor line; processing the scan signal to establish a baseline signal from the sensor line representing an undisturbed state of the optical fiber sensor line; and comparing the scan signals to the baseline signal. A fault signal is generated in response to receiving a scan signal having a predetermined deviation from the baseline signal. The method includes processing the fault signal to establish a nature and location of a fault condition occurring in the barrier at the entrance; and alerting personnel of the fault condition.

DESCRIPTION OF THE DRAWINGS

The construction designed to carry out the invention will hereinafter be described, together with other features thereof.

The invention will be more readily understood from a reading of the following specification and by reference to the accompanying drawings forming a element thereof, wherein an example of the invention is shown and wherein.

DESCRIPTION OF A PREFERRED EMBODIMENT

Figures 1, 1A:
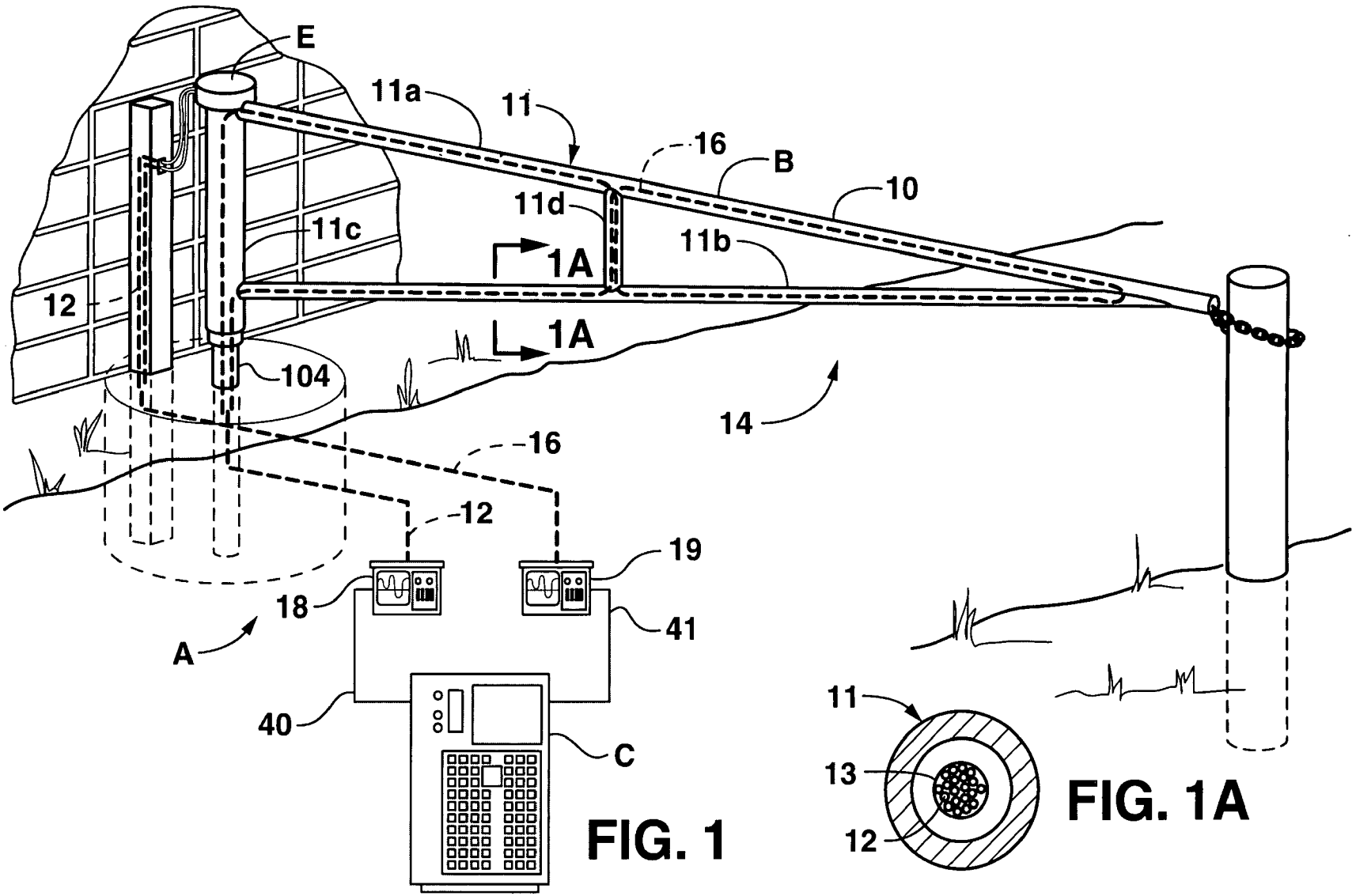
FIG. 1 is a schematic diagram illustrating one embodiment of a gate assembly for an entrance security system according to the invention.
FIG. 1A is a sectional view taken along line 1A-1A of FIG. 1.

The present invention is now described more fully herein with reference to the drawings in which the preferred embodiment of the invention is shown. This invention may, however, embody other forms and should not be construed as limited to the embodiment set forth herein. Rather, these embodiments are provided so that this disclosure will be thorough and complete and will fully convey the scope of the invention to those skilled in the art.

The detailed description of some of the components that follow may be presented in terms of steps of methods or in program procedures executed on a computer or network of computers. These procedural descriptions are representations used by those skilled in the art to most effectively convey the substance of their work to others skilled in the art. These procedures herein described are generally a self-consistent sequence of steps leading to a desired result. These steps require physical manipulations of physical quantities such as electrical or optical signals capable of being stored, transferred, combined, compared, or otherwise manipulated. A computer readable medium can be included that is designed to perform a specific task or tasks. Actual computer or executable code or computer readable code may not be contained within one file or one storage medium but may span several computers or storage mediums. The terms "computer," "processor," and "server" may be hardware, software, or combination of hardware and software that provides the functionality described herein, and may be used interchangeably.

Certain aspects of the present invention are described with reference to flowchart illustrations of methods, apparatus ("systems"), or computer program products according to the invention. It will be understood that each block of a flowchart illustration may be implemented by a set of computer readable instructions or code. These computer readable instructions may be loaded onto a general purpose computer, special purpose computer, or other programmable data processor or processing apparatus to produce a machine such that the instructions will execute on a computer or other data processing apparatus to create a means for implementing the functions specified in the flowchart block or blocks. Accordingly, elements of the flowchart support combinations of means for performing the special functions, combination of steps for performing the specified functions and program instruction means for performing the specified functions. It will be understood that each block of the flowchart illustrations can be implemented by special purpose hardware based computer systems that perform the specified functions, or steps, or combinations of special purpose hardware or computer instructions.

Referring now to the drawings, the invention will now be described in more detail. As can best be seen in FIGS. 1 and 2, an entrance security system, designated generally as A, is schematically illustrated. The security system includes a barrier assembly component, designated generally as B, serving to prevent passage through an entrance of a secured area; and a security interface component, designated generally as C. Barrier assembly B prevents passage of a vehicle, individual, or other object, and generates a fault signal if attempt is made to compromise the barrier closing an entrance 14 into a secured area. The illustrated embodiment, barrier component includes a removable gate 10 closing an entrance into a secured area. The gate includes a plurality of elongated, hollow structural elements 11 arranged in an intersecting pattern forming a triangular gate. The gate structure includes a horizontal element 11*a*, an intersecting element 11*b*, a base element 11*c*, and an intermediate element 11*d*. It is to be understood, of course, that the barrier component may be a movable gate, a fixed grate, or any other barrier structure closing an entrance, and may be formed in a grid pattern of parallel cross elements, a pattern of interesting or inclined elements, and other arrangements servicing as a barricade to entrance of a secured area. For the purpose that will become apparent hereinafter, structural elements 11 include hollow cores 13.

A fiber optic sensor line 12 is laced through the hollow cores of hollow elements 11 forming the barrier component, as illustrated in FIG. 1. The fiber optic sensor line enters the gate from the 'left' side. It enters the structure of the gate and is 'laced' through each structural 11*a*-11*d* component of the gate assembly. Any attempt to cut the center of the gate, or a supporting pivot post 104 will result in a cutting of the fiber. The sensor line is connected to a scanning unit 18 on one end and to a terminal device 15 on its terminal end. The terminal end of the cable need not be physically or electrically connected to the OTDR. The scanning unit scans the sensor line and receives back a scan signal 40. Any suitable scanning unit, such as an optical time domain reflectometer (OTDR) may be used.

A sensor unit E is secured to the top of gate post 104 for sensing the opening of gate 10 in a manner to be described in more detail hereinafter. Sensor unit E includes an optical fiber sensor line 16 connected to an OTDR 19. A line scan signal 41 is output from OTDR 19 representing the current condition of sensor line 16.

In the illustrated embodiment, security interface component C processes scan signals 40, 41 for detecting a prescribed signal attenuation and for determining the nature of an intrusion attempt and identifies the barrier and entrance involved. Fiber optic cable 12 is used to sense opening of the barrier gate. Line scan signal 40 is received by the security interface system and processed to determine if an unauthorized gate movement has occurred. Fiber sensor line 16 is used to detect an attempt to sever, or severance, of a structural element 11 in barrier B. Line scan signal 41 is processed according to established signal characteristics to determine a break or attempted break in the line. Thus, the product provides the capability to monitor a gate at a remote entrance and provide a status (open or closed) and an assessment of any attempt to open the gate, or cut the gate intermediate its ends.

Figure 2:
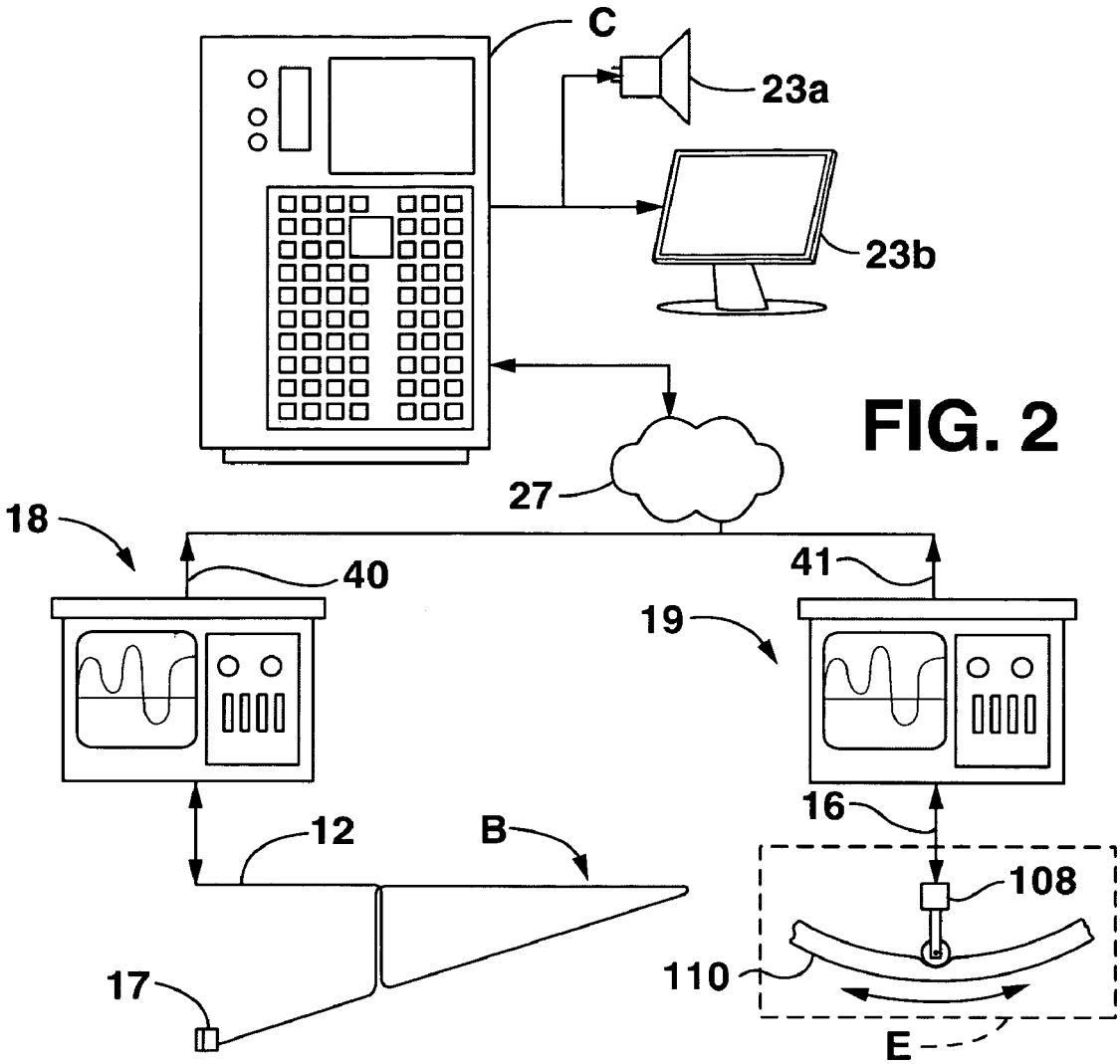
FIGS. 2 and 3 are schematic diagrams illustrating a computerized security interface component for an entrance security system according to the invention.
Figure 3:
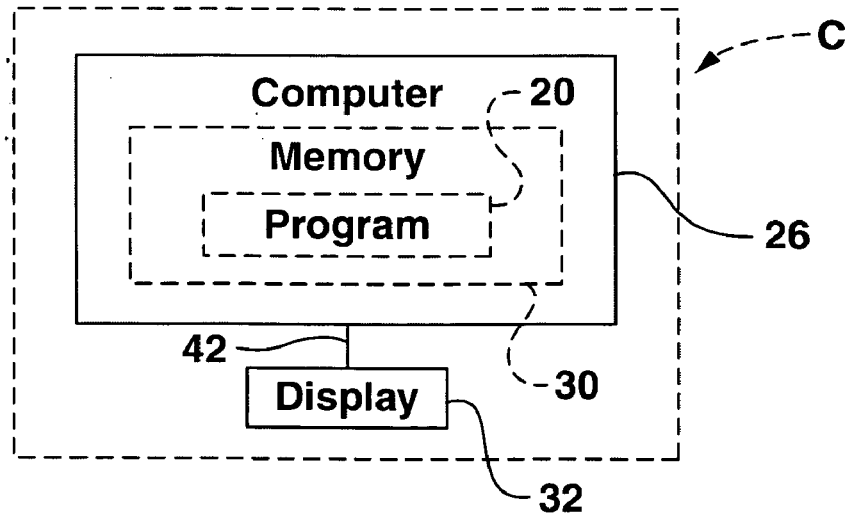

As can best be seen in FIG. 2, security interface component C includes a computer 26 having a computer program 28 containing a set of operating instructions embodied in a computer readable code residing in a memory 30 of the computer. The computer is connected to a display 32 or other communicating device for communicating the occurrence of a fault signal 42 to an operator of the system.

Figure 4:
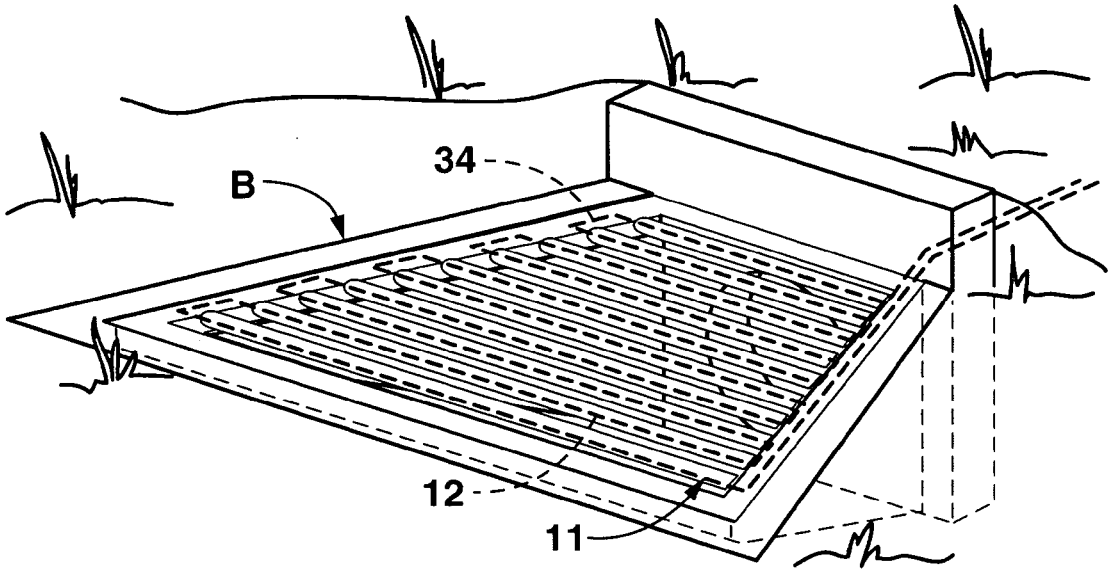
FIG. 4 is a perspective view of a grate barrier covering the entrance of a culvert having access to a secured area wherein a sensor line is laced through tubular grid elements of the grate according to the invention.
Figure 5:
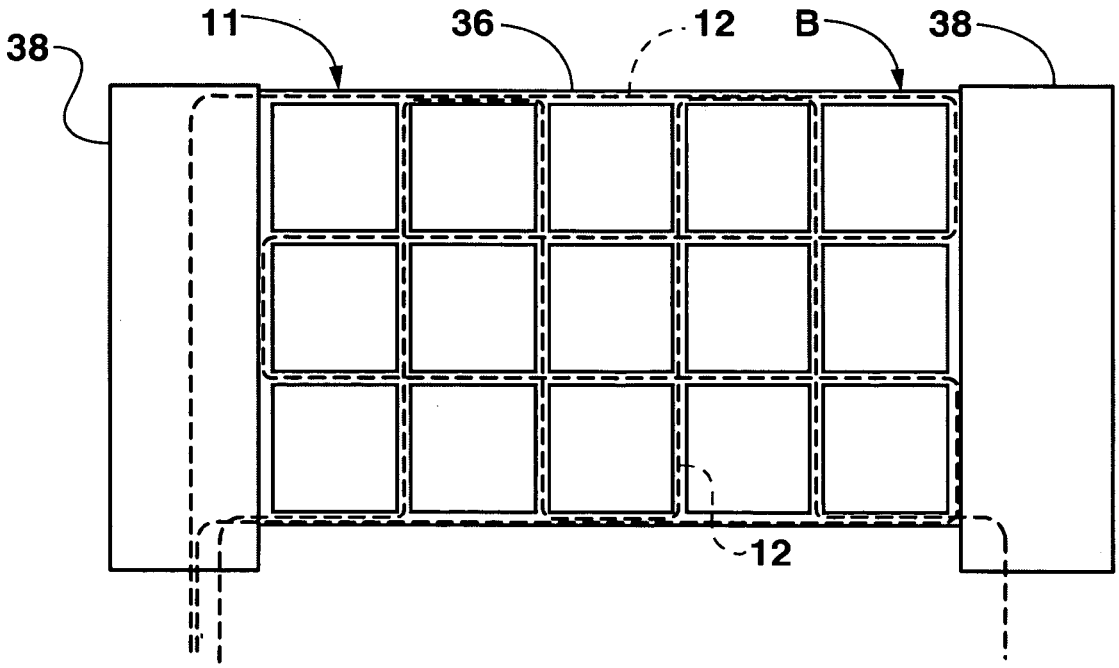
FIG. 5 is a perspective view of another embodiment of an entrance barrier in the form of an entrance gate providing access to a secured area wherein a fiber optic sensor line is laced through the hollow grid elements of the gate.

In the event the line is severed, or the gate is impacted, a fault signal 42 will be generated. As used herein, "fault condition" means a condition in which a structural element 11 of gate 10 has been cut or broken through by a vehicle, or individual, and/or encountered material damage, as distinguished from accidental damage. Fault condition also means an unauthorized opening of the barrier gate to a prescribed open position. While the security system is illustrated as combining the OTDR system 18, 19, other applications may only require one. For example, FIG. 4 illustrates barrier component B in the form of a fixed grate 34 closing an entrance to a culvert leading to a secured area. The grate includes a series of parallel structural elements 11 laced with one or more sensor lines 12 connected to individual scanning units. FIG. 5 illustrates barrier component B in the form of a gate 36 (moveable), or a grate (fixed), having structural elements 11 arranged in an intersection grid pattern with one or more sensor lines 12 laced through the grid the gate or grate closes an entrance through walls or fencing 38. For example, if the barrier is a fixed grate that is generally unmovable, only system 18 may be needed.

The interface security system is computerized and initially must establish a base line signal D for the scan signals 40 coming from the laced gate sensor line 12, and a separate base line signal D for scan signals 41 coming from the sensor unit E. Since the procedure for establishing the base line scan signal is the same, only the procedure for establishing the base line signal for laced sensor line 12 will now be described. It being understood that the procedure for establishing the base line for scan signals 41 is the same.

OTDR 18 continuously scans the optical sensor line within gate assembly B and communicates scan signals 40 in the line to security interface component C, as will be explained more fully below. Computer 26 is programmed to compare the scan signals to a baseline signal D to determine whether predetermined signal deviation representing a fault condition has occurred. In the event the fault condition is detected, fault signal 42 is generated by the interface component along with a computation of the type of fault and location of the fault condition at entrance 12. For example, display 32 may include a map of the area depicting the location of the entrance and fault condition on the map.

Conventional input devices, such as a keyboard or mouse, may be provided for operating computer 26. Other means of displaying the OTDR signal may also be used.

Figure 6:
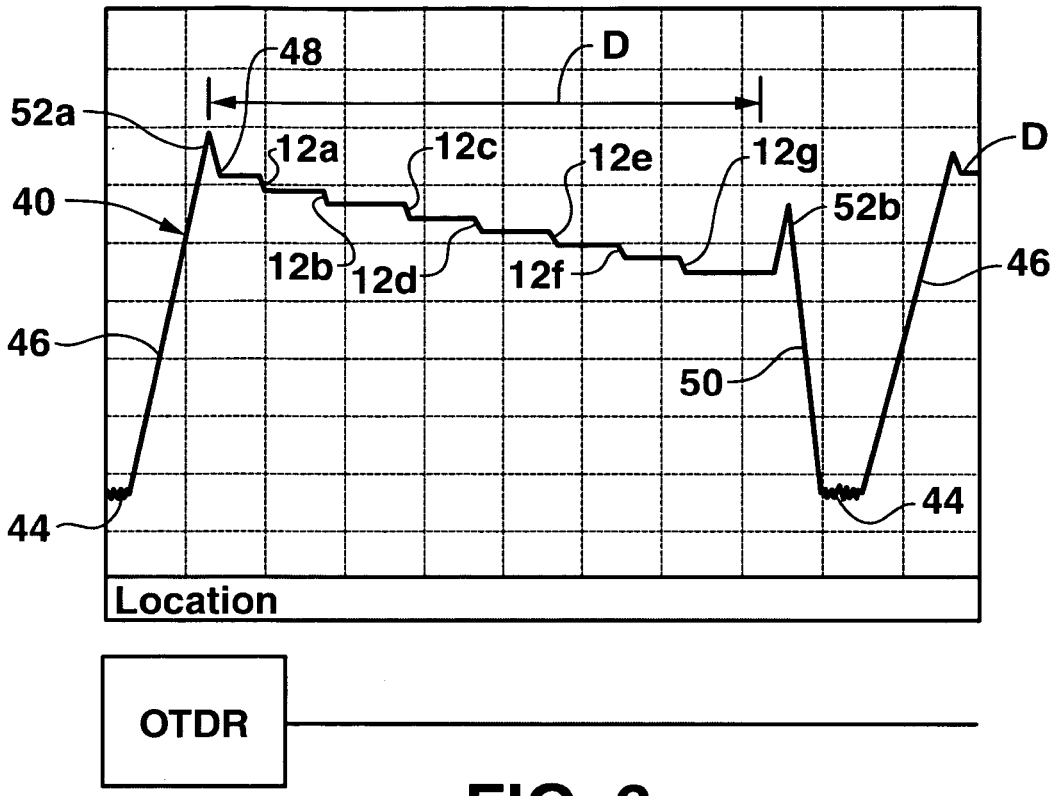
FIG. 6 is a graphic display of the OTDR signal when the vehicle denial security is in a normal, undisturbed condition.

Computer 26 continuously monitors scan signals 40 produced by OTDR 18 when scanning the fiber optic cable. When the computer is first turned on, the computer acquires baseline signal D from the OTDR, as can best be seen in FIG. 6. The baseline represents the status of the fiber optic cable being monitored at a normal, undisturbed state. For example, while initially scanning the line the scan signal will likely include some noise attenuations at 44, followed by a launch signal 46 in the scan. A launch is created by a significant attenuation or spike in the scan to a normalized level. The normalized level at 48 is the beginning of baseline signal D. The system continues to read the baseline until a drop occurs at 50. The drop indicates the end of sensor line 12 being scanned. After the drop, noise 44 again will be recorded by the OTDR. The computer system will then ignore small peaks 52*a* and 52*b* at the beginning and at the end of the baseline signal which is merely reflections of the launch and the drop. Baseline signal D established for the security application being made will be compared to all future scans of the fiber optic line to determine if a fault condition has occurred.

During scanning, computer 26 continuously receives scan signals 40 representing scans of fiber optic cable 12 from OTDR 18. A cable being monitored will have a characteristic baseline signal depending on the security application being made and security configuration. A straight cable extending perfectly vertical from the OTDR will be one of the few instances that no attenuations will be found in the baseline. As illustrated in FIG. 1, fiber optic sensor line 12 will likely have seven characteristic bends when laced through the hollow structural elements of barrier gate B. The bends will likely produce seven distinctive attenuations at 12*a* through 12*g*. Each attenuation represents one of the bends in the lines at the intersections of the structural elements. With each repetitive scan, the computer system compares the scan signal to the baseline signal to see if any signal deviations and attenuations are detected. If a signal deviation is detected, the computer analyzes the deviation signal to determine what type of fault has occurred, as well as the specific location of the fault. If the scan attenuation matches a baseline attenuation, such as at 12*a*-12*g*, the computer system will not recognize a fault condition.

Thus, every attenuation detected by the computer system will not indicate a fault and may simply indicate a pre-existing bend attenuation. Further, some signal attenuations will be slight, indicating a slight movement of the cable that does not indicate a fault. The signal deviations that most concern a user of this system will be those that show a significant fault. The location of the attenuation on the signal will correspond to a location on the fiber optic cable where a fault may have occurred.

Figure 7:
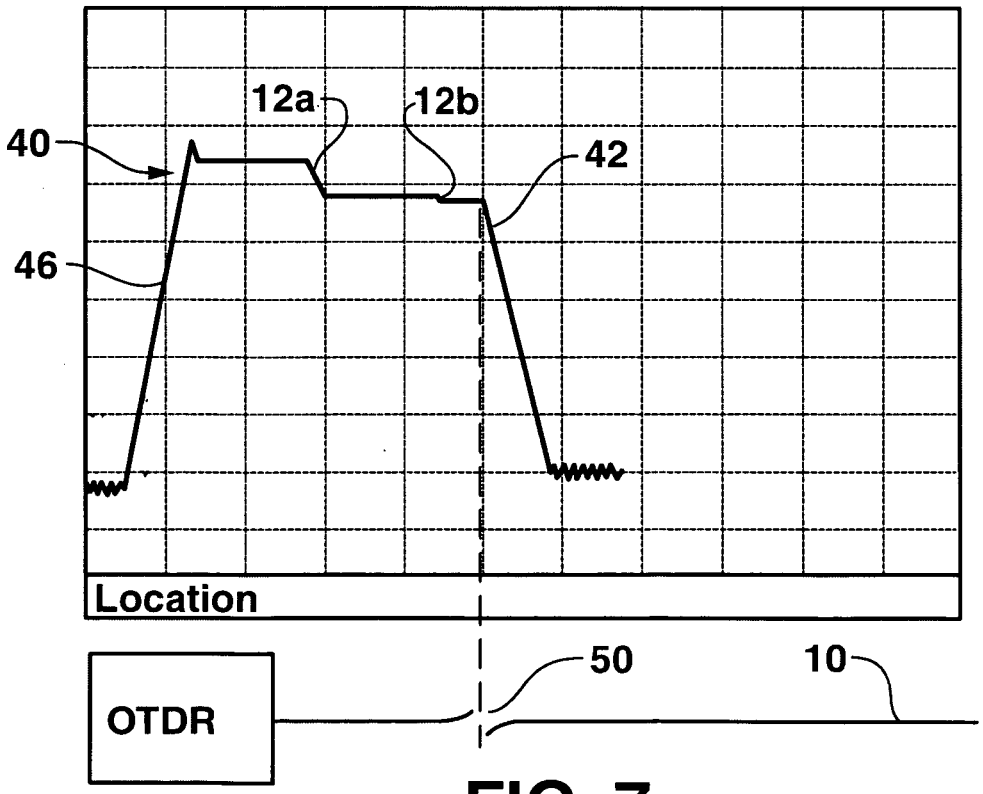
FIG. 7 is a graphic display of the OTDR signal when a fault condition has occurred in the barricade component of the security system, and a characteristic fault signal is produced.

As can best be seen in FIG. 7, in the event that a fault condition 50 is created in gate 10, fault signal 42 occurs in scan signal 40. Computer analysis involving a comparison of baseline signal D and fault signal 42 indicates an abrupt deviation in attenuation sufficient to create a fault signal. Computer 26 generates a fault signal which is delivered to display 32 in the form of a map or other information indicating the location of the fault condition which may be looked up in a computerized table. For example, an attenuation of −62 DB may represent a complete break in the optical fiber sensor line 12 and hence the barrier gate or grate. This information may be stored in a table format allowing for quick retrieval by computer readable instructions. A fault condition distance of 2,100 meters may be the location of an entrance gate to the secured area according to the location lookup table. A computer generated map may be quickly displayed at 32. Various ways of responding to the fault condition may be had at that time. For example, law enforcement personnel may be dispatched immediately to the location, various alarms may be activated, and other means of communicating the fault condition in a manner dictated by the security application being made.

Computer program 28 includes instructions for communicating with OTDR 18 and receiving repetitive scan signals, and analyses instructions for comparing the scan signals to the baseline signal which has been established. The instructions include lookup instructions for looking up the location of a fault signal in the event the analysis instructions determine a deviation from the baseline signal. The lookup instructions look to see if the deviation matches the level of deviation required to indicate a complete break of the sensor line, material damage to the line, and/or other conditions in the line which amount to a fault condition. The computer program may also include a map of the secured area and instructions to look up the location of the fault condition in response to the distance measured by the OTDR. Display instructions may include instructions for displaying the map and the location on display 32. Alarm instructions can be used to alert the attendant to the map display and the fault signal generally.

Figure 8:
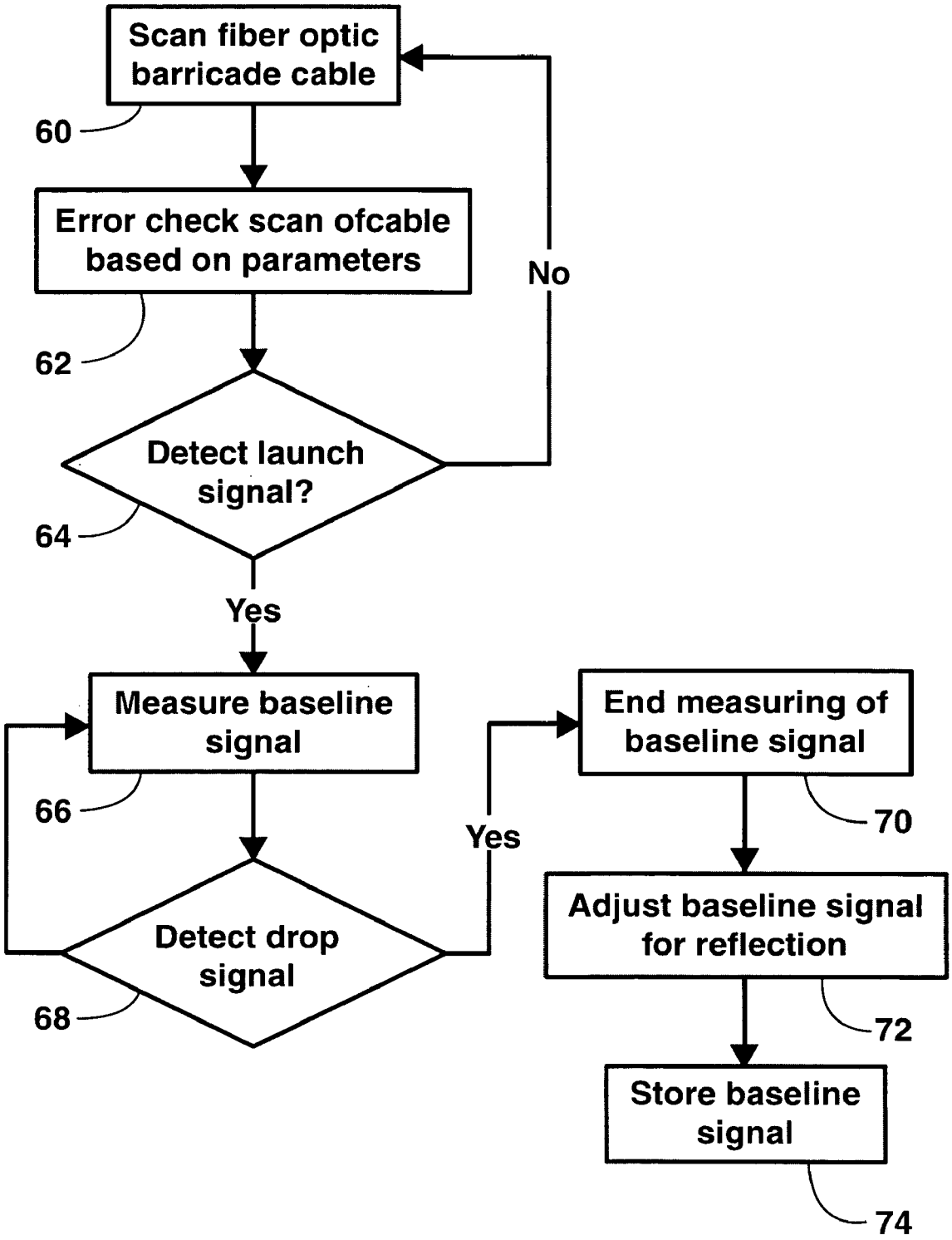
FIGS. 8-9 are flow charts for a security interface system for detecting a fault in the barricade security component and producing a characteristic signal indicating the location of the fault.
Figure 9:
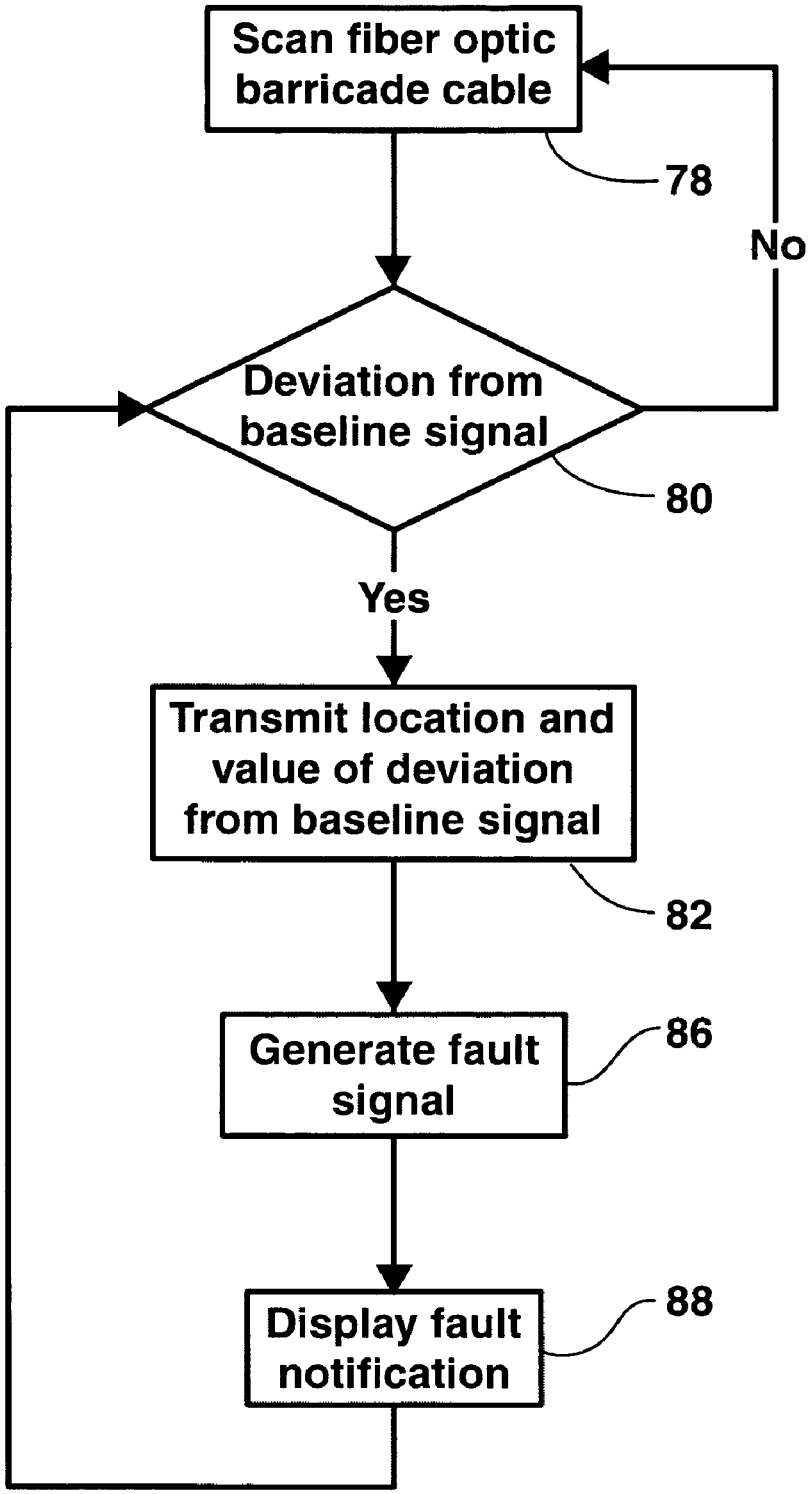

Referring now to FIGS. 8 and 9, flowcharts detailing the computerized operation of the security system are shown. FIG. 8 shows the initialization process of determining baseline D from scan signal 40 associated with barricade cable 10 in the security system. At step 60, the system initially scans fiber optic sensor line 12, extending through barricade cable 10. At step 62, the system error checks the information coming from the fiber optic line or cable. For example, a user may input parameters indicating the length of the cable to be scanned. If the length scanned by the system is greater or less than this parameter length, then the system will return an error and rescan the line from the start to ensure a proper base line is detected. Other parameters such as attenuations that should be found in the line may also be entered to assist in error checking. If a launch signal 46 is detected at step 64, the system will begin acquiring and storing baseline signal D in computer memory 30 at step 46. If the attenuation is not considered a launch signal, the system will continue to scan fiber optic line 12 until it detects a launch attenuation. The launch signal occurs when a significant rise from the noise floor occurs in the reading of the signal from the OTDR. Any insignificant attenuations simply indicate noise 44 and do not show the beginning or the end of the baseline signal.

Once the system has acquired a launch and begun measuring the baseline at step 66, it will continue to do until it detects a drop signal 50 at step 68. The drop signal is the inverse of the launch signal indicating the end of the baseline signal. The drop signal returns the scan signal of the fiber optic line to noise 44. At this point, the system will end acquiring the baseline at step 70. At step 72 the computer analysis adjusts the baseline signal for reflection. There is a distance immediately following the launch and immediately preceding the drop that is not a measurement of the baseline but rather a reflection signal at 52*a* and 52*b* occurring at the beginning and end of the line. This reflection is not be considered element of baseline signal D, therefore, it is removed from the baseline signal at step 72. At step 74, the actual baseline is stored by the system in computer memory for comparison to future scan signals. The baseline is necessary in order to make all comparisons to future scans to determine a fault condition is occurring in the braided security cable of the barricade component.

FIG. 9 shows an overview of the normal operation of the security system while scanning the sensor line. After establishing the baseline signal, the scanning of the line will take place at step 78. The system will determine if any attenuation deviation from the baseline is detected at step 80 while scanning the sensor line. If no deviation from the baseline has taken place, the system will return to step 78 and continue to scan the line for an attenuation deviation. Attenuation deviations do not necessarily have to indicate a fault. Sometimes attenuations will indicate the crimping or some other bend in the sensor cable. If these existed at the time of the determination of the baseline, then no action is taken if the attenuation found matches this baseline attenuation. If the attenuation does not match the attenuations in the baseline signal, the system will look up the deviation level and determine if a fault signal condition exists. If so, the computer will generate a fault signal at 86. The fault signal can comprise multiple indicators. For example, an audible indication may be given to the user of the system indicating a fault. In a further embodiment, a visual indication may be given to the user indicating the location of the fault. In a further embodiment, the visual display may comprise a map with an indication at the point on the map where the fault has taken place.

Figure 10:
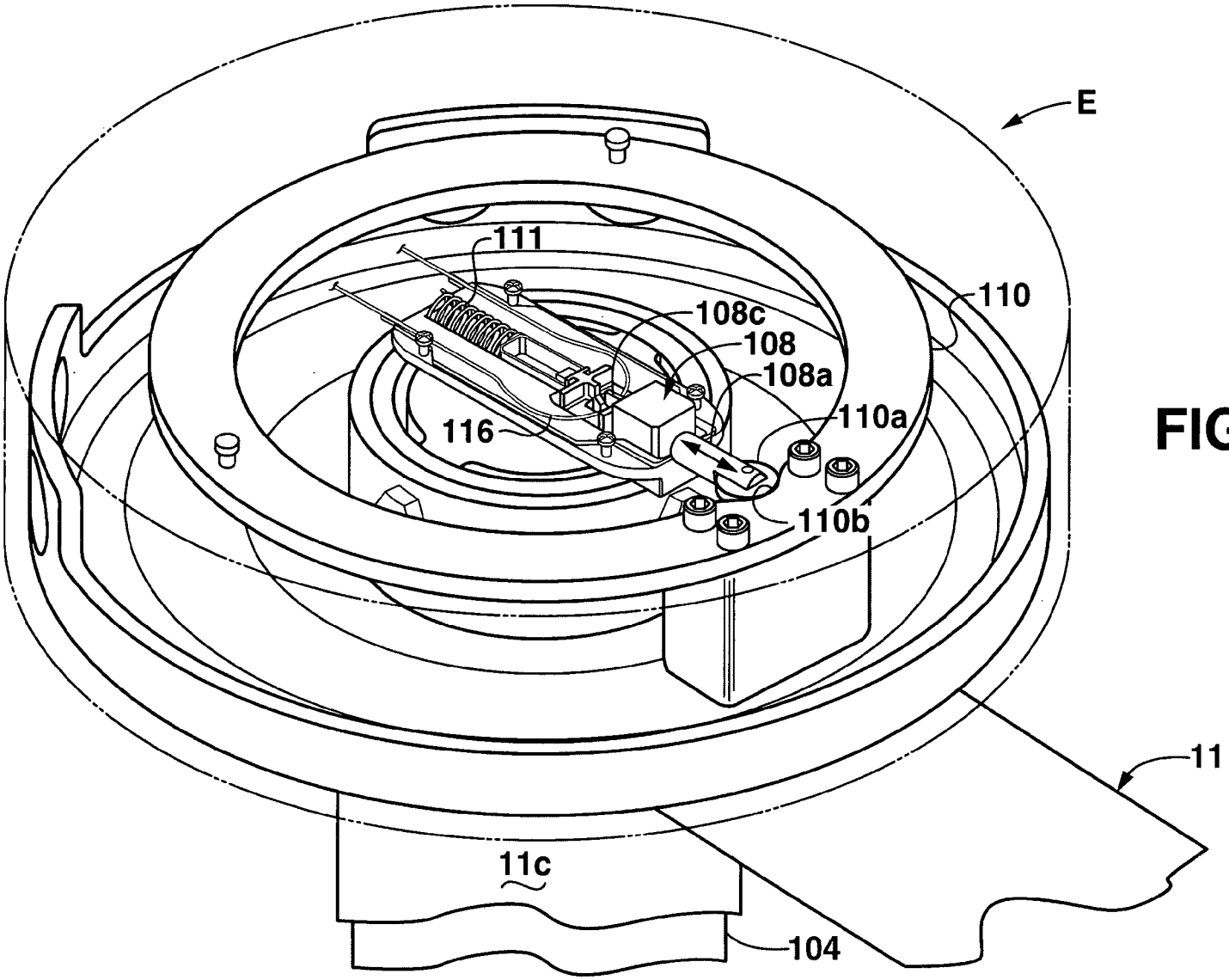
FIG. 10 is a perspective view of a barrier gate opening sensor according to the invention in a closed position.
Figure 11:
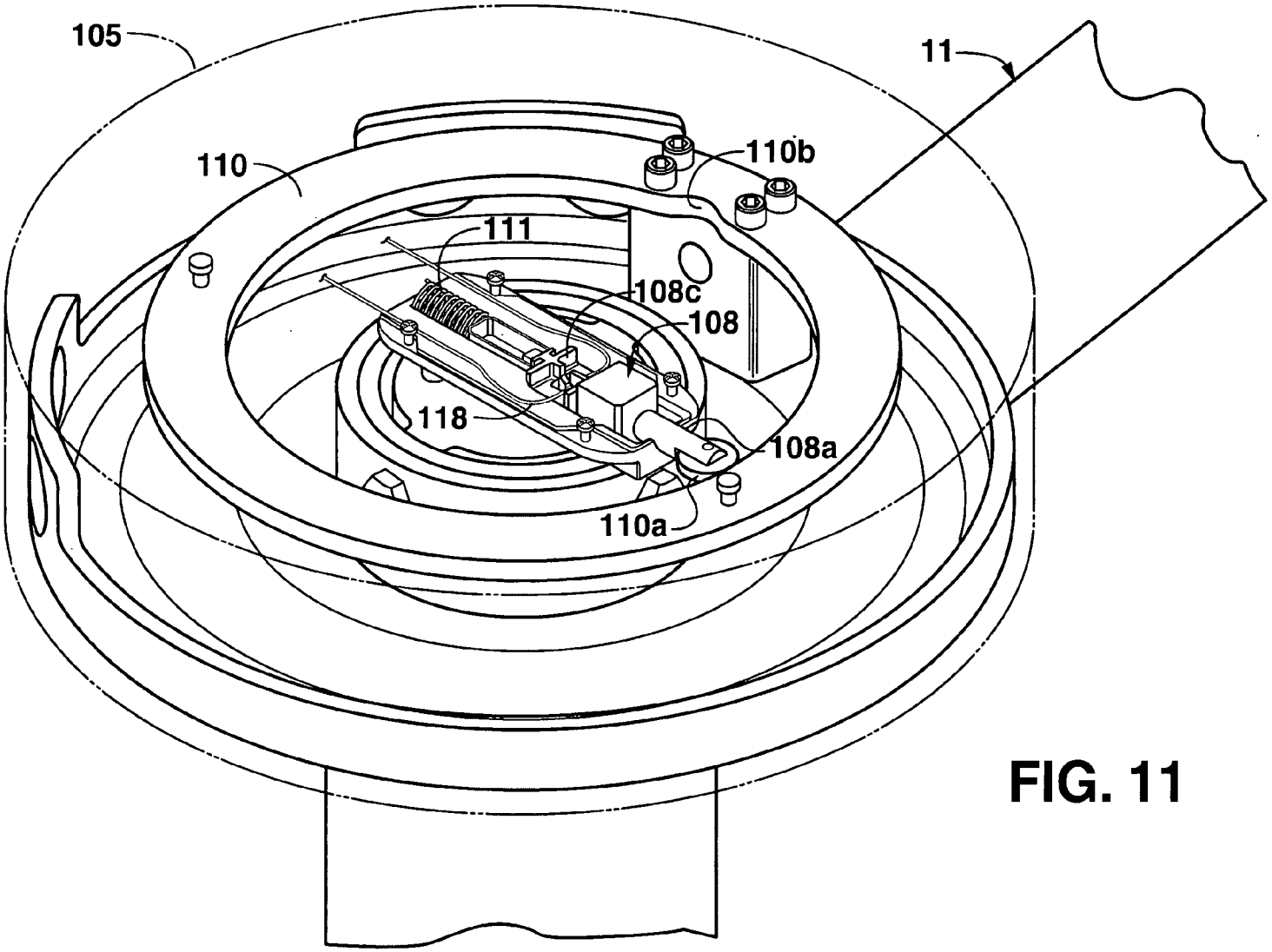
FIG. 11 is a perspective view of a barrier gate opening sensor according to the invention in a tripped position.

Referring to FIGS. 10-11, an embodiment of a barrier gate opening sensor in the form of a sensor unit E will now be described in more detail. The invention provides monitoring of vehicle or pedestrian gates on entrances in perimeter fencing or walls, barriers and gates on other entrances leading to a secured area, and between areas of varying security within a facility. There are two principle methods to breach an entrance barrier or gate; (1) opening the gate with a key, or by cutting the chain or locking device, or (2) cutting through one or more structural elements forming a element of the gate between the ends of the gate assembly, as described above. The invention provides a capability to detect either of these methods to breach a gate. When coupled with the software, both the nature of the breach and the exact gate involved can be ascertained from a remote monitoring location.

The opening and closing of gate 10 of gate assembly B is monitored by means of sensor unit E mounted on pivot post 104 supporting the gate components. This arrangement is illustrated in FIGS. 10 and 11. Sensor unit E includes a protective housing 105 mounted atop the pivot post of the gate assembly. Inside the housing is fiber optic cable sensor switch 108 having a reciprocating switch actuator 108*a*, and a cam in the form of a cam plate 110. As the gate opens or closes, the cam plate is turned. The sensor is 'tripped' when the cam plate is rotated from a closed position (FIG. 10) to an open position (FIG. 11).

As can best be seen in FIG. 10, cam plate 110 and sensor switch 108 are shown in the 'gate closed' position. The cam plate is attached to structural element 11*c* which serves to rotate on pivot post 104 of the gate assembly and rotates with element 11*c* as the gate is moved. A cam follower 110*a* is mounted to sensor actuator 108 which presses against optical senor fiber line 16 when the cam rotates. When the gate is closed, the fiber sensor line rests in a normal loop 116 within the sensor.

In the illustrated embodiment, switch actuator 108*a* is slidably received in a housing block 108*b*. Sensor line 16 received in a cradle 108*c* having opposed contact surfaces between which the sensor like is received. In the closed position, the cam follower is urged into cam plate detent 110*b* by a spring 111.

As illustrated in FIG. 11, gate 100 has been opened. Now, cam plate 110 has rotated 90 degrees from the 'gate closed' position. Cam follower 110*a* moves inwardly causing switch actuator 108*a* to move so that a characteristic bend 118 is formed in the fiber. The computer processor detects this bend and recognize it as a gate opening The software 28 recognizes the specific entrance where the unlawful activity is occurring. Once gate 10 is opened and the fiber bent, opening the gate further will not change the signal produced by the fiber because the constant surface provided by the cam maintains a constant pressure by cam follower 110*a* on the fiber 16. When the gate is returned to its closed position, the sensor switch is returned to the gate closed position (FIG. 10). When the cam follower 110*a* returns to detent 110*b* in cam plate 110, pressure is no longer exerted on the optical fiber.

While a preferred embodiment of the invention has been described using specific terms, such description is for illustrative purposes only, and it is to be understood that changes and variations may be made without deelementing from the spirit or scope of the following claims.

What is claimed is:

1. A security system for detecting an unauthorized activity and attempt to enter through an entrance of a secured area comprising:

an entrance gate for controlling entry through the entrance including a plurality of structural elements form a barrier closing the entrance;

a first fiber optic sensor line for sensing a first fault condition representing an unauthorized attempt to open the gate;

a second fiber optic senor line for sensing one of an attempted severance and severance of a structural element of the gate;

a first fiber optic scanning unit for scanning the first optical sensor line and receiving scan signals estimating attenuations in the first optical sensor line;

a second fiber optic scanning unit for scanning the second optical sensor line and receiving scan signals estimating attenuations in the second optical sensor line;

at least one system computer for receiving and processing the scan signals in real-time representing the condition of the first and second optical sensor lines and generating a real-time fault signal in response to a predetermined attenuation in one or more of the scan signals indicating the unauthorized activity has occurred; and a communication device communicating notice of the fault signal to security personnel.

2. The system of claim 1 wherein the processing of the scan signals includes comparing the first and second real-time scan signals to pre-established first and second baseline scan signals which are characteristic of the first and second sensor lines, respectively, in an undisturbed state.

3. The system of claim 1 including a computer readable medium in communication with the computer; and a computer program including computer readable instructions in communication with the computer readable medium which includes:

receiving instructions for receiving scan signals from the scanning unit;

baseline initialization instructions for establishing a baseline signal based on initial information from the scan signals;

monitoring instructions for monitoring the optical sensor line by automatically receiving the scan signals in real-time representing the condition of the optical sensor line in real-time;

comparison instructions for determining if unauthorized activity has taken place based on a real-time comparison of the baseline signal and the scan signals;

fault instructions for generating a real-time fault signal in response to a predetermined change in one or more of the scan signals indicating the unauthorized activity has taken place; and the computer outputting a warning in response to the fault signal to notify an attendant that the unauthorized activity has taken place.

4. The system of claim 1 further comprising:

a visual display in communication with the system computer; and the set of computer readable instructions include display instructions for visually indicating the occurrence of a fault on the display.

5. The system of claim 1 wherein the entrance gate includes a barrier composed of hollow structural elements having hollow cores, and the first optical sensor line is laced through the hollow cores of the structural elements.

6. The system of claim 5 wherein the entrance gate is moveable and has an open position allowing entry and a closed position preventing entry, and the system includes a sensor unit disposed relative to the entrance gate to detect movement of the gate toward the open position and generate a fault signal.

7. The system of claim 6 wherein the sensor unit includes a first sensor element fixed relative to the gate and a second sensor element carried for movement with the gate.

8. The system of claim 7 wherein one of the first and second sensor elements includes a reciprocating sensor actuator having a deactivated position and an activated position, the sensor actuator engaging the second sensor fiber upon the unauthorized movement of the entrance gate causing the sensor activator to move to the activated position and the fault signal to be generated.

9. The system of claim 8 wherein the sensor unit includes a fiber chamber for receiving the second optical sensor line, the reciprocating sensor actuator being carried in the fiber chamber to contact the senor line and form a predetermined bend in the second sensor fiber when activated to produce the predetermined fault signal that is readily recognizable by the processor to reliably detect a sensor activation.

10. An entrance denial security system for detecting a fault condition at one or more entrances into a secured area representing unauthorized activity and an attempt to gain entry through the entrance, the system comprising:

an entrance barrier closing an entrance into a secured area;

the barrier including a plurality of hollow elongated structural elements forming a rigid integral barrier, said elongated structural element having elongated hollow interior cores;

an optical fiber sensor line extending through the interior hollow cores of the structural elements of the entrance barrier for detecting the fault condition;

a scanning unit operatively connected to an end of the sensor line generating a series of optical scan pulses for transmission from said end outbound along said sensor line and said end receiving reflections of said scan pulses returned back along said sensor line;

a system processor interfaced with the scanning unit for receiving said reflections of said scan pulses, said processor having a set of computer readable instructions stored in a memory on said processor for processing said reflections determining a fault condition and generating a fault signal in response to the occurrence of a fault condition and identifying the entrance where the fault condition occurred; and a communication device operatively associated with the processor for communicating the fault signal so that a proper security response can be made to the fault condition.

11. The system of claim 10 wherein the fault condition includes the sensor line being severed.

12. The system of claim 11 wherein the fault condition includes the structural elements being materially damaged to an extent affecting the condition of the sensor line which causes generation of the fault signal.

13. An entrance denial security system for detecting a fault condition at one or more entrances into a secured area representing unauthorized activity and an attempt to gain entry through the entrance, the system comprising:

a moveable entrance gate including a plurality of structural elements forming an integral barrier structure closing the entrance;

the entrance gate having an open position allowing entry and a closed position preventing entry;

a sensor unit disposed relative to the entrance gate to detect movement of the gate toward the open position;

the sensor unit being associated with an optical fiber sensor line for detecting a prescribed movement of the gate from the closed position toward the open position and generating a fault signal if the prescribed movement is detected;

the sensor unit including a first sensor element that is fixed relative to the gate and a second sensor element that moves with the gate; and one of the first and second sensor elements including a reciprocating sensor actuator having a deactivated position and an activated position, the sensor actuator engaging the sensor fiber upon the unauthorized opening of the entrance gate causing the sensor actuator to move to the activated position and the fault signal to be generated.

14. The system of claim 13 wherein the reciprocating sensor actuator forms a predetermined bend in the sensor fiber when activated to produce a predetermined fault signal that is readily recognizable by the processor to reliably detect a sensor activation.

15. The system of claim 14 wherein the sensor unit includes a sensor housing having a fiber chamber, the sensor fiber being routed through the fiber chamber with a natural bend producing no attenuation in the sensor fiber when the sensor is deactivated, and the sensor actuator engaging the natural bend of the sensor fiber to form the predetermined bend in the sensor fiber when the sensor is activated causing attenuation in the sensor fiber and generation of the intrusion signal.

16. The system of claim 13 wherein the first sensor element includes one of a cam follower and a cam; and the second sensor element including the other one of the cam follower and cam; the cam follower being operatively associated with the reciprocating sensor actuator.

17. The system of claim 13 including a scanning unit for scanning the sensor line and receiving real-time scan signals indicating the current condition of the sensor line, and the processor processing the scan signals to detect if one of a plurality of fault conditions has occurred.

18. The system of claim 17 including a baseline scan signal representing the scan signal in the senor line in an undisturbed state, and the processor compares the real-time scan signals to the baseline scan signal to determine if a predetermine fault condition has occurred.

19. The system of claim 13 wherein said entrance gate is a swing gate that pivots about a support structure, and the first sensor element carried by the support structure and the second sensor element carried by the swing gate.

20. The system of claim 13 wherein the gate includes one of a parallel and intersecting pattern of the structural elements.

21. A method of preventing an unauthorized entry through an entrance into a secured area comprising:

providing an optical fiber sensor line laced through the interior of a plurality of hollow structural elements forming a barrier closing the entrance;

interfacing a computer system having programmed instructions with said sensor line;

generating a series of real-time scan signals in the fiber sensor line and receiving reflection signals returned back along said sensor line representing the current state of the fiber sensor line;

processing the reflection signals on said system computer according to the programmed instructions to initially establish a baseline signal from the sensor line representing an undisturbed state of the optical fiber sensor line and storing the baseline signal in a computer storage medium;

comparing the reflection signals to the baseline signal according to the programmed instructions, and generating a fault signal in response to receiving a reflection signal having a predetermined deviation from the baseline signal;

processing the deviation signal on said system computer according to the programmed instructions to establish a type and nature and location of a fault condition occurring in the barrier at the entrance; and alerting personnel of the fault condition.

22. The method of claim 21 including generating the scan signal using an optical time domain reflectometer (OTDR).

23. The method of claim 21 wherein the fault condition includes the sensor line being severed.

24. The method of claim 21 including scanning the sensor line with a scanning unit operatively connected to one end of the optical sensor line and receiving reflection signals representing the current condition of the sensor line, and transmitting the scan signals to the processor.

25. The method of claim 24 wherein the barrier includes an entrance gate having an open position for entry and a closed position preventing entry; and the method comprises detecting a prescribed movement of the gate toward the open position by comparing the reflection signal to the baseline signal, and generating the fault signal.

26. The method of claim 24 wherein the barrier includes a fixed gate closing the entrance wherein the gate includes one of a parallel and intersecting pattern of the hollow structural elements laced with at least one of the optical fiber sensor lines, and the method includes detecting one of a severance and attempted severance of the sensor line by comparing the scan signal to the baseline signal.

27. The system of claim 1 wherein the second fault condition further includes the structural elements being materially damaged to an extent affecting the condition of the sensor line which causes generation of the fault signal.

28. An entrance denial security system for detecting a fault condition at one or more entrances into a secured area representing unauthorized activity and an attempt to gain entry through the entrance, the system comprising:

an entrance barrier closing an entrance into a secured area;

the barrier including a plurality of hollow elongated structural elements forming a rigid integral barrier, said elongated structural element having elongated hollow interior cores;

an optical fiber sensor line extending through the interior hollow cores of the structural elements of the entrance barrier for detecting the fault condition;

a scanning unit operatively connected to an end of the sensor line generating a series of optical scan pulses for transmission from said end outbound along said sensor line and said end receiving reflections of said scan pulses returned back along said sensor line;

a system processor interfaced with the scanning unit for receiving said resections of said scan pulses, said processor having a set of computer readable instructions stored in a memory on said processor for processing said reflections determining a fault condition and generating a fault signal in response to the occurrence of a fault condition and identifying the entrance where the fault condition occurred;

a communication device operatively associated with the processor for communicating the fault signal so that a proper security response can be made to the fault condition; and said computer readable instructions stored in a memory of the processor which includes instructions for continuously receiving said reflections of said pulses scan from the fiber optic sensor line, comparing a base line signal to the scan pulses, generating a fault signal in the event the comparison indicates a fault condition, and activating the communication device in response to the fault signal being generated so that personnel are alerted to the fault condition and the location thereof.

29. A method of preventing an unauthorized entry through an entrance into a secured area comprising:

providing an optical fiber sensor line laced through the interior of a plurality of hollow structural elements forming a barrier closing the entrance;

interfacing a computer system having programmed instructions with said sensor line;

generating a series of real-time scan signals in the fiber sensor line and receiving reflection signals returned back along said sensor line representing the current state of the fiber sensor line;

processing the reflection signals on said system computer according to the programmed instructions to initially establish a baseline signal from the sensor line representing an undisturbed state of the optical fiber sensor line and storing the baseline signal in a computer storage medium;

comparing the reflection signals to the baseline signal according to the programmed instructions, and generating a fault signal in response to receiving a reflection signal having a predetermined deviation from the baseline signal;

processing the deviation signal on said system computer according to the programmed instructions to establish a type and nature and location of a fault condition occurring in the barrier at the entrance; and said fault condition includes the structural elements being materially damaged to an extent affecting the condition of the sensor line which causes generation of the fault signal; and alerting personnel of the fault condition.

30. A method of preventing an unauthorized entry through an entrance into a secured area comprising:

providing an optical fiber sensor line laced through the interior of a plurality of hollow structural elements forming a barrier closing the entrance;

interfacing a computer system having programmed instructions with said sensor line;

generating a series of real-time scan signals in the fiber sensor line and receiving reflection signals returned back along said sensor line representing the current state of the fiber sensor line;

processing the reflection signals on said system computer according to the programmed instructions to initially establish a baseline signal from the sensor line representing an undisturbed state of the optical fiber sensor line and storing the baseline signal in a computer storage medium;

comparing the reflection signals to the baseline signal according to the programmed instructions, and generating a fault signal in response to receiving a reflection signal having a predetermined deviation from the baseline signal;

processing the deviation signal on said system computer according to the programmed instructions to establish a type and nature and location of a fault condition occurring in the barrier at the entrance;

the barrier includes an entrance gate having an open position for entry and a closed position preventing entry; and the method comprises detecting a prescribed movement of the gate toward the open position by comparing the reflection signal to the baseline signal, and generating the fault signal; and alerting personnel of the fault condition.

* * * * *